US006971687B2

(12) United States Patent
Amy

(10) Patent No.: US 6,971,687 B2
(45) Date of Patent: Dec. 6, 2005

(54) DOOR AND CABINET CATCH

(76) Inventor: Ron Amy, P.O. Box 263, Penngrove, CA (US) 94951-0263

( * ) Notice: Subject to any disclaimer, the term of this patent is extended or adjusted under 35 U.S.C. 154(b) by 211 days.

(21) Appl. No.: 10/689,378

(22) Filed: Oct. 20, 2003

(65) Prior Publication Data

US 2005/0082841 A1 Apr. 21, 2005

(51) Int. Cl.[7] ..... E05C 19/10
(52) U.S. Cl. ..... 292/128; 16/85
(58) Field of Search ..... 292/342, 343, 292/128, 102, 136; 16/86 A, 86 B, 86 R, 16/86 C

(56) References Cited

U.S. PATENT DOCUMENTS 1,111,759 A * 9/1914 Parker ..... 292/17
1,126,836 A * 2/1915 Newton ..... 16/85
1,309,310 A * 7/1919 Voight ..... 292/234
1,481,582 A * 1/1924 Woolliscroft ..... 16/84
4,159,837 A * 7/1979 Morita ..... 292/127

* cited by examiner

*Primary Examiner*—Gary Estremsky
(74) *Attorney, Agent, or Firm*—Johnson & Stainbrook, LLP; Craig M. Stainbrook; Larry D. Johnson

(57) ABSTRACT

Door and cabinet catch with a bumper member, a bumper housing, a compression spring, a ball with stem, a ball joint mounting plate, a ball joint nut, a catch member and an L shaped catch retaining member. The bumper housing includes a clevis that hingably retains the catch member. The catch member includes a spring biased tab for opening the catch member. The compression spring holds the bumper member in an extended position so that it can compress during use thereby reducing the chance of rattling. A preferred embodiment includes that the ball joint allows the bumper housing and bumper member to angle as much as thirty degrees in any direction through a three hundred and sixty degree arc thereby making it possible to obtain a latching action even if the relationship between the catch member and the catch retaining member is not parallel.

3 Claims, 7 Drawing Sheets

DOOR AND CABINET CATCH

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of door accessory hardware and more specifically to a door and cabinet catch.

Cabinet doors and doors that can close off or open up an entrance to a room or the like are well known. On a moving vessel or vehicle such as a boat or a recreational vehicle, doors present a particular problem in that they must remain open or closed during times when the vessel or vehicle are in motion. For boats in particular, motion is a constant factor of life even when the boat is not traveling to a destination but still in water. Various solutions have been tried and marketed for helping to keep doors in boats or vehicles in the closed position or in the open position until the user desires to change the open or closed status. In particular, the present invention is designed to hold doors in the open position. Current mechanisms for holding doors in the open position include standard question mark shaped hooks that pivot on a retaining bracket mounted on a door and interact with a second retaining bracket mounted on a wall or the like. Also included are magnetic catches that help keep a door open, wedge shaped devices that can slide under an open door to hold it open. Still other designs include various types of mechanical catches that, by spring force, retain a door in the open position until the user overcomes the spring tension and releases the catch to allow the door to close. However, there are deficiencies in the prior designs that the present invention overcomes. First, most catches that are available today have a certain amount of play or looseness with respect to the retaining portion of the device and the catch portion of the device. This looseness can cause annoying rattling to occur. Second, There are occasions where the relationship between the open door and the wall that the retaining member is attached to are not parallel to each other thereby making the interaction between the catch and the retaining member difficult or impossible. Finally, there are instances where the distance between the open door and the wall where the retaining member is, is significantly greater than the length of the catch mechanism thereby making it impossible to use the catch mechanism.

BRIEF SUMMARY OF THE INVENTION

The primary object of the invention is to provide a catch for holding doors open.

Another object of the invention is to provide a catch that does not rattle in environments such as the interior of a boat, motor home or the like.

Another object of the invention is to provide a catch that can work even if the relationship between the catch and the catch plate is not parallel.

A further object of the invention is to provide a catch that can work for full length doors as well as cabinet doors.

Another object of the invention is to provide a catch that can be extended to work on an open door whose distance from a wall is excessive.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a door and cabinet catch comprising: a bumper member, a bumper housing, a compression spring, a ball with stem, a ball joint mounting plate, a ball joint nut, a catch member, an L shaped catch retaining member, said bumper housing including a clevis that hingably retains said catch member, said catch member hingably pinned to said clevis and including a spring biased tab for releasing said catch member, said compression spring retained in said bumper housing and abutting the back end of said bumper, said ball joint nut threaded onto mating male threads on said bumper housing thereby retaining said ball of said ball joint, said bumper member held in an extended position and able to compress during use when said catch member engages with said catch retaining member thereby reducing the chance of rattling, and said ball fixedly attached to said ball joint mounting plate so that said ball is centrally located and raised off of said mounting plate by said ball stem which is an ideal orientation, to adjust up to approximatly thirty degrees in any direction, for a door catch where said mounting plate is fastened to a wall or floor.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
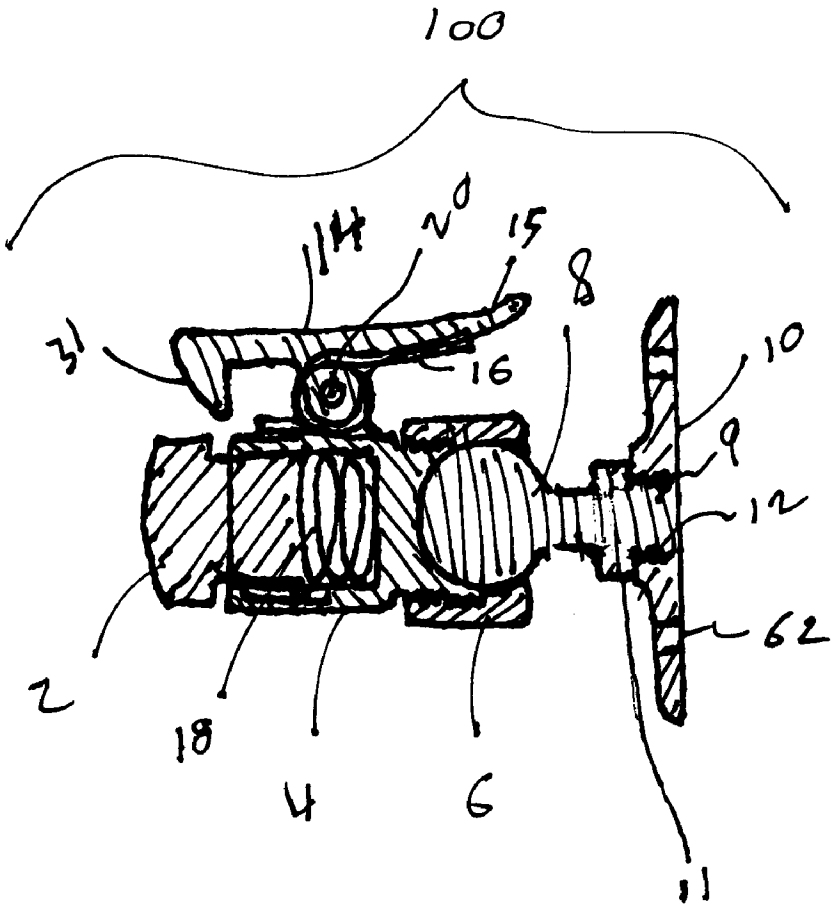
FIG. 1 is a side section view of the invention.
Figure 2:
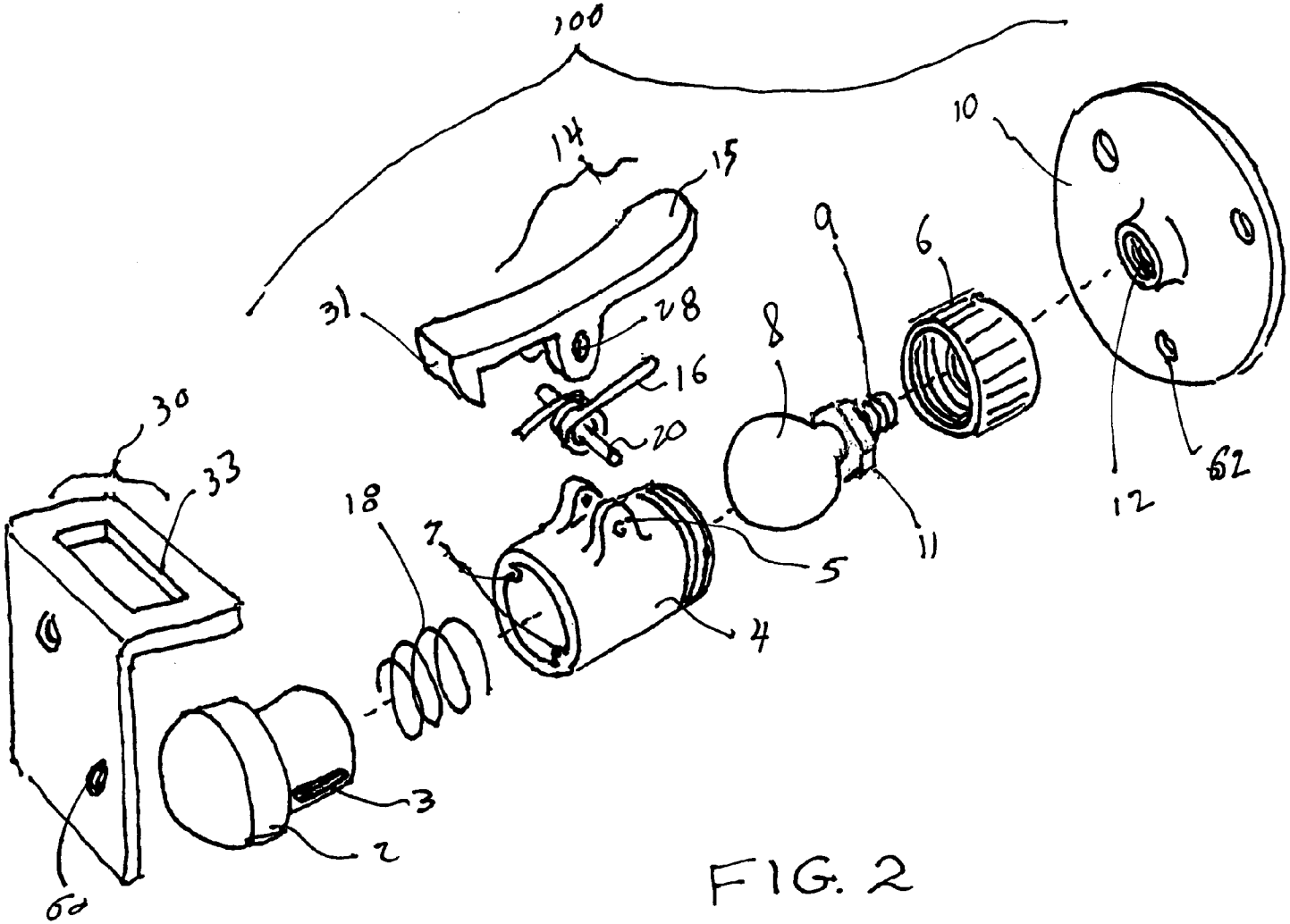
FIG. 2 is an exploded view of the invention.
Figure 3:
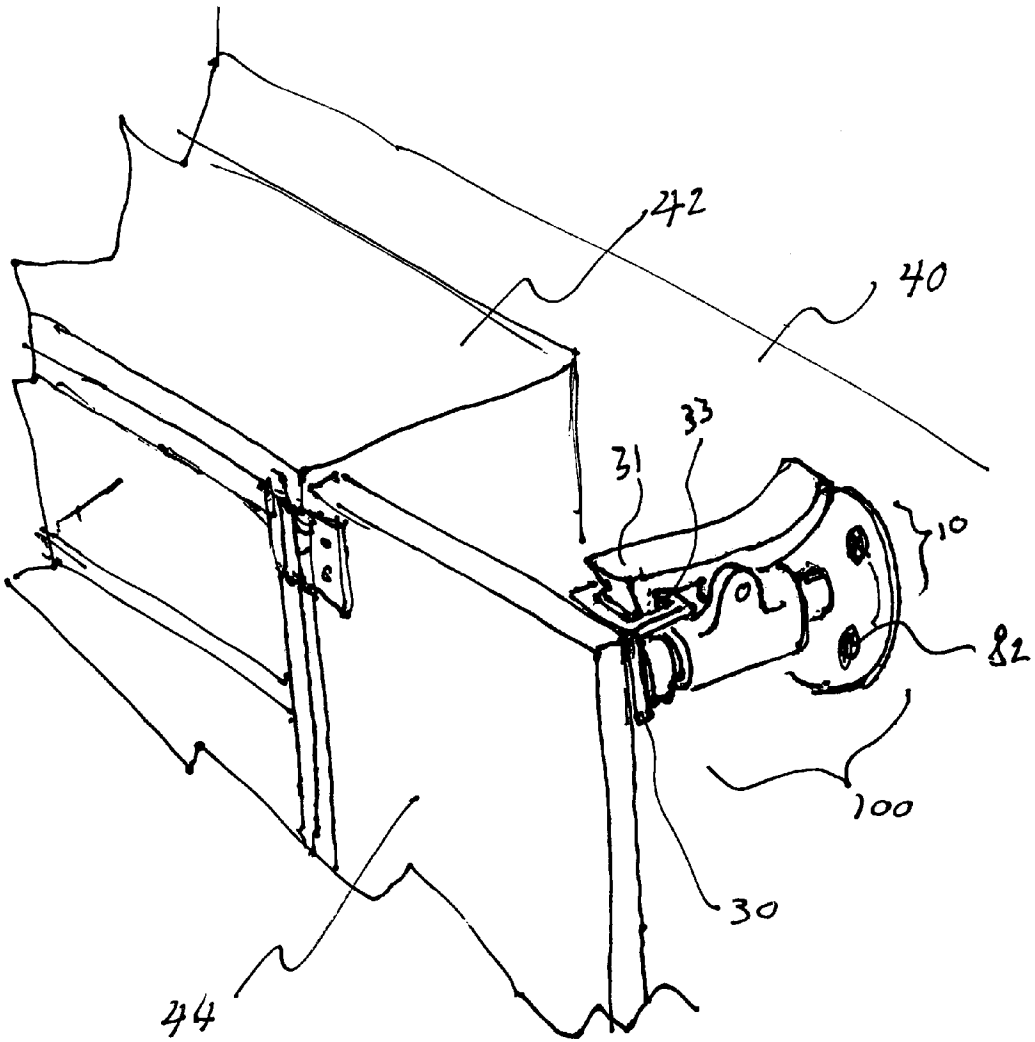
FIG. 3 is a perspective view of the invention in use on a cabinet door.
Figure 4:
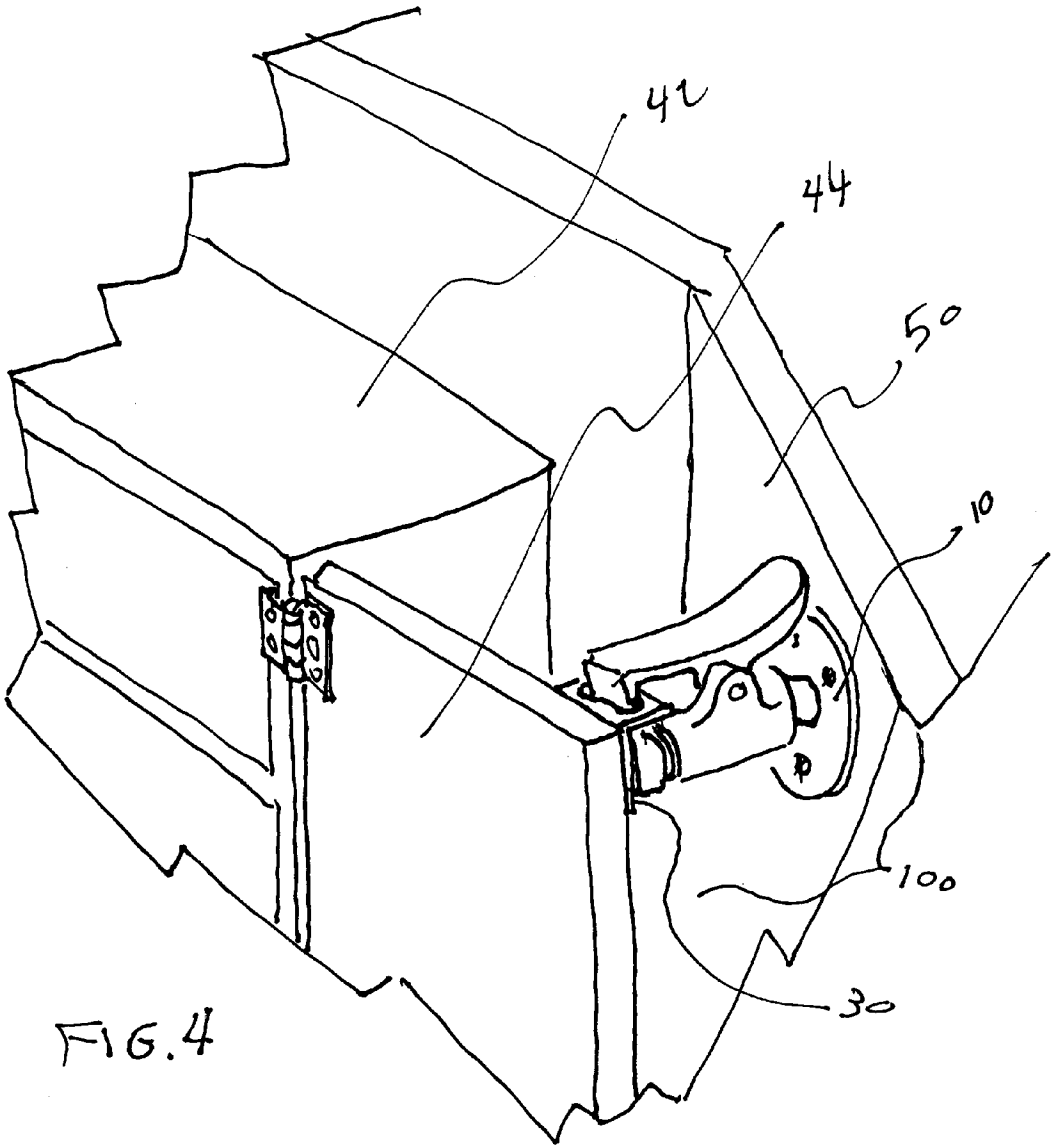
FIG. 4 is a perspective view of the invention in relation to a wall that has a compound angle.
Figure 5:
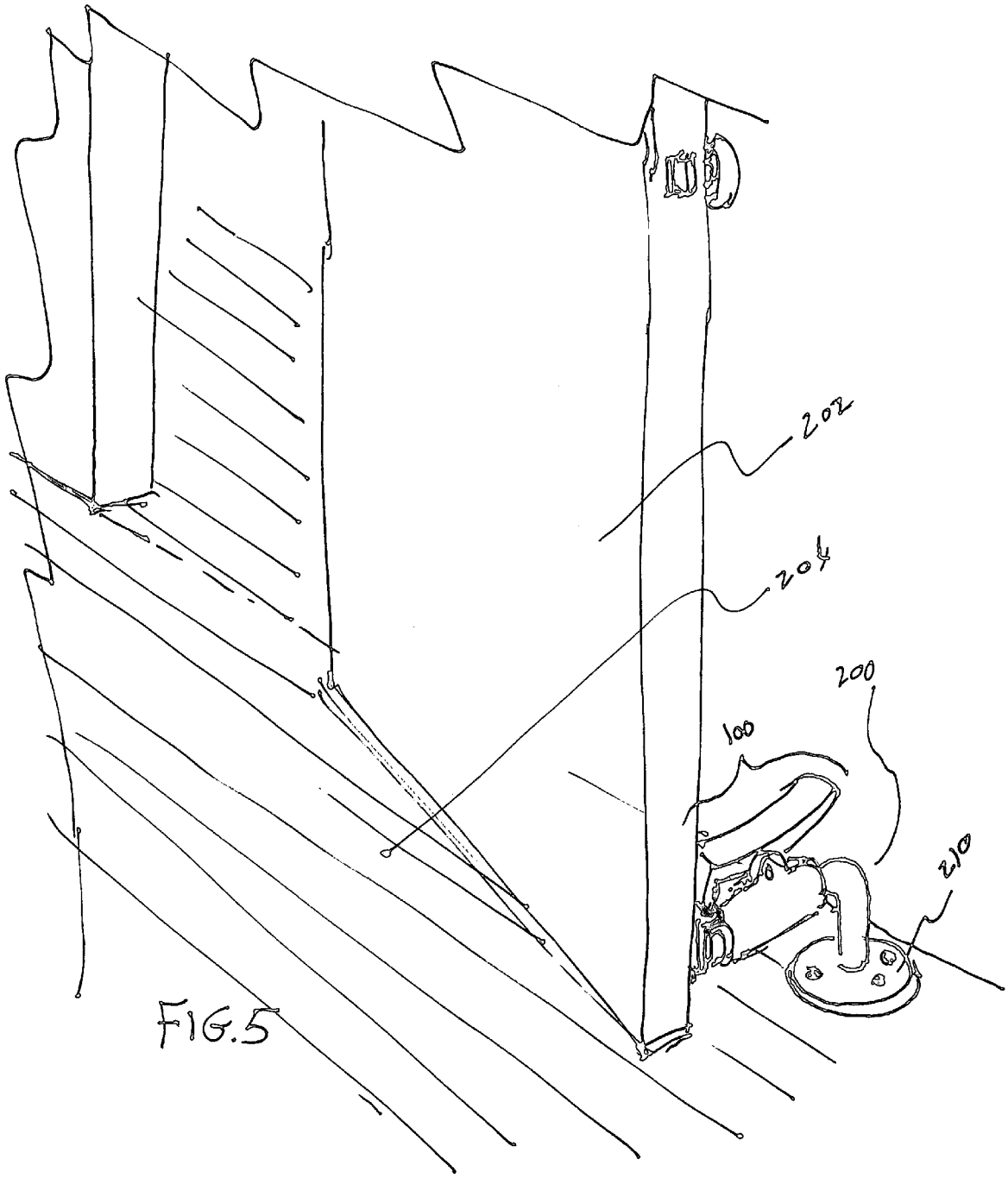
FIG. 5 is a perspective view of a floor mount version of the invention in use on a full length door.
Figure 6:
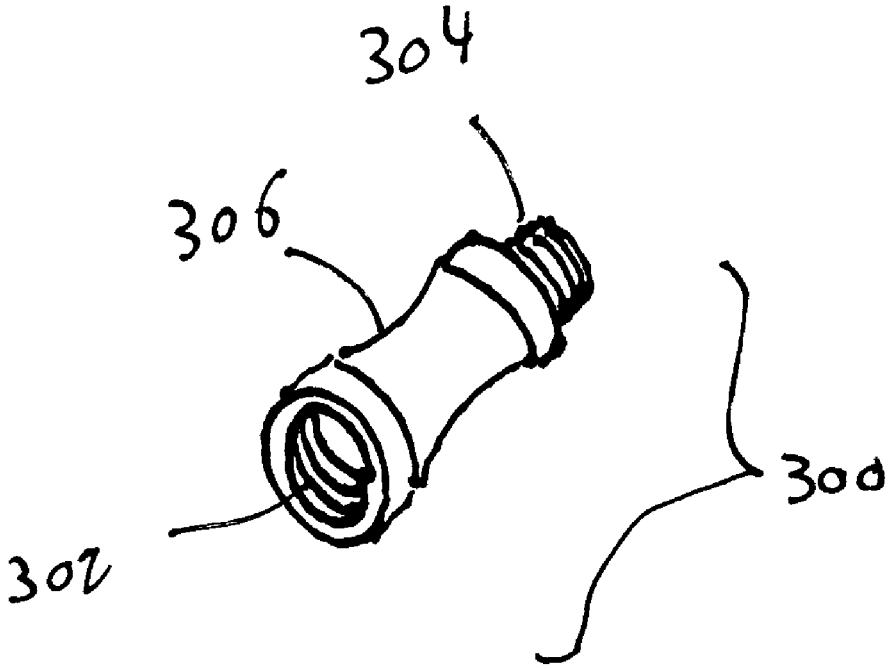
FIG. 6 is a perspective view of an extension member for the invention.
Figure 7:
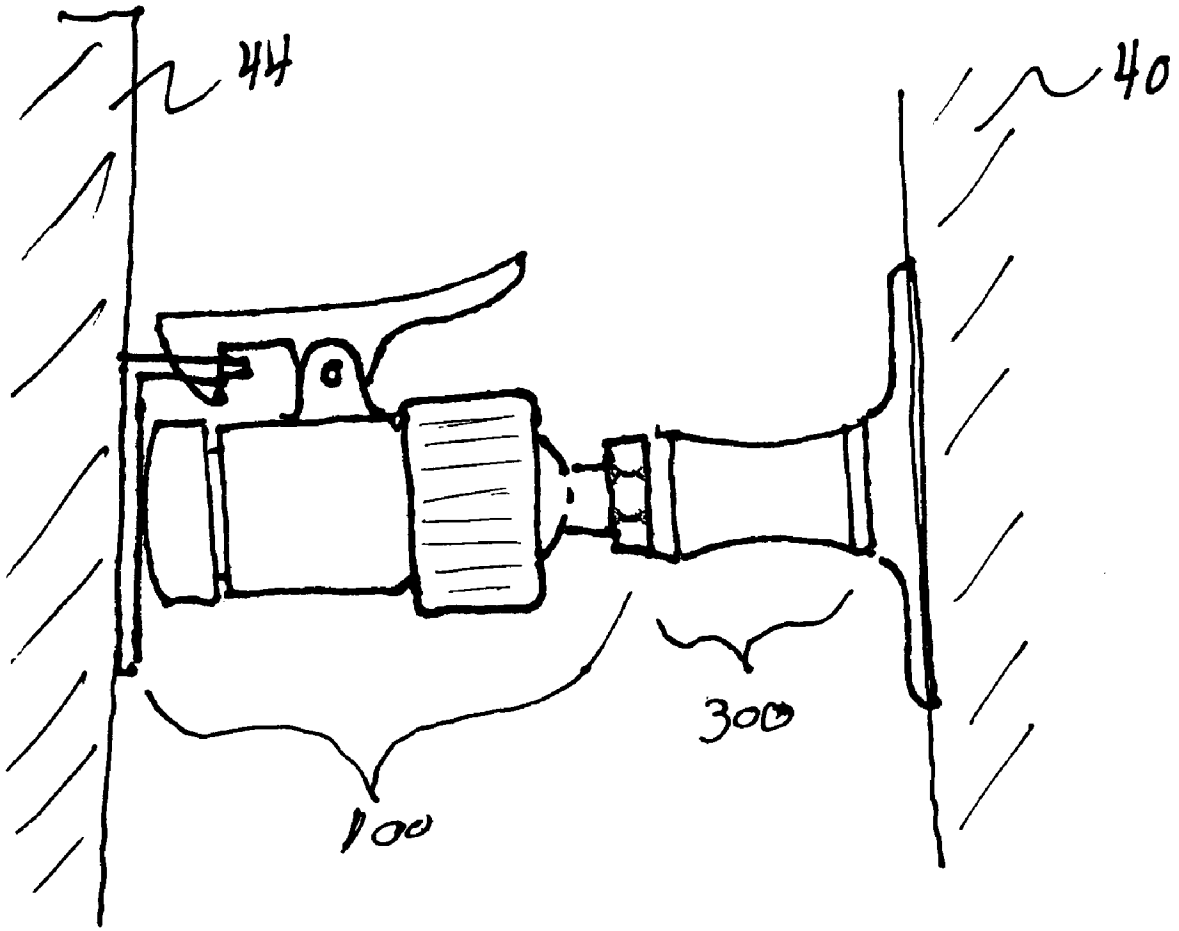
FIG. 7 is a side view of the invention with an extension member in place.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Referring now to FIG. 1 we see a side section view of the present invention 100. A bumper member 2 is made of resilient material such as injection molded EVA plastic. The bumper 2 is held in an outwardly biased position by compression spring 18. The bumper 2 is partly retained by a cylindrical concavity in housing 4. The opposite end of housing 4 includes a partially spherical concavity that can retain a ball joint 8. Housing 4 is constructed of rigid material such as die cast metal. Ball joint 8 is retained by threaded retainer nut 6 that mates with corresponding threads on the outside of bumper housing nut 4. Threaded ball stem 9 and hex portion 11 are integrally attached to ball 8. Stem threads 9 engage with mating treads 12 located in wall attachment plate 10. Housing 4 also includes a clevis joint 5, shown clearly in FIG. 2, that hingedly 20 engages with catch retaining member 14. Catch retaining member 14 includes a retaining end 31 and a finger press end 15. The catch retaining member 14 is maintained in a downwardly biased position by torsion spring 16. FIG. 2 shows an exploded view of the invention 100, including cabinet catch member 30. Catch 30 is a metal flat member that is bent at a ninety degree angle and includes an aperture 33 that can removably retain the tip 31 of latch retaining member 14. Catch 30 includes apertures 60 which allow it to be screwed to a cabinet door or the like. Attachment plate 10 can be screwed to a wall or the like using screw apertures 62. Bumper 2 includes a linear recess 3 and a mirror image recess, not shown, on its opposite side. Tabs 7 located on front end of housing 4 slidably engage with recess 3 so that the bumper 2 is prevented from fully exiting housing 4. Because the bumper 2 is spring biased, the front of the bumper is guaranteed to fully engaged with the face of catch 30 when latch retainer end 31 engages with latch aperture 33 thereby eliminating the chance of rattling. FIG. 3 shows the present invention 100 in use. Cabinet 42 is mounted to a straight wall 40. Cabinet door 44 is swung open and catch 30 is mounted to the outside of the cabinet door 44 so that its aperture 33 can engage with the latch tip 31. Catch wall plate 10 is screwed to the wall 40 by screws 82. In this configuration, the cabinet door can remain in an open position even during periods of motion as is experienced in a moving boat or recreational vehicle or the like. Of course, the same catch mechanism 100 can be used with full length doors or other swinging members. FIG. 4 shows the same catch assembly 100 in use with a door 44 and a wall that has two planes 50. In this application, the ball joint 8 described above allows the wall mounting plate 10 to be mounted flatly on wall 50 even though the wall plate 10 and the cabinet door 44 are not parallel vertically or horizontally. FIG. 5 shows and alternate embodiment of the invention where the ball stem 200 is bent at a ninety degree angle thereby allowing it to be screwed into floor plate 210 that is screwed to floor 204. This configuration allows the invention 100 to engage with a standard door 202 and floor 204. This configuration is ideal when no wall exists behind the door 202 or when it would be aesthetically undesirable to attach the catch mechanism 100 to a wall. FIG. 6 shows a perspective view of an extension member 300 which is comprised of a body 306 having a female threaded portion 302 at one end and a mal threaded portion 304 at the opposite end. FIG. 7 shows a side view of the present invention 100 with extension piece 300 in place so that the present invention 100 can be used even if the distance between wall 40 and door 44 is greater than the normal distance. Multiple extension pieces 300 can be screwed together to accommodate even greater distances between a wall 40 and a door or the like 44.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Door and cabinet catch comprising:

a bumper member;

a bumper housing;

a compression spring;

a ball with stem;

a ball joint mounting plate;

a ball joint nut;

a catch member;

an L shaped catch retaining member;

said bumper housing including a clevis that hingably retains said catch member;

said catch member hingably pinned to said clevis and including a spring biased tab for opening said catch member;

said compression spring retained in said bumper housing and abutting the back end of said bumper;

said ball joint nut threaded onto mating male threads on said bumper housing thereby retaining said ball of said ball joint;

said bumper member held in an extended position and able to compress during use when said catch member engages with said catch retaining member thereby reducing the chance of rattling;

and said ball fixedly attached to said ball joint mounting plate so that said ball is centrally located and raised off of said mounting plate by said ball stem which is an ideal orientation for a cabinet door catch where said mounting plate is fastened to a wall.

2. Door and cabinet catch as claimed in claim 1 wherein said ball joint allows said bumper housing and bumper member to angle as much as thirty degrees in any direction thereby making it possible to obtain a latching action even if the relationship between said catch member and said catch retaining member is not parallel.

3. Door and cabinet catch as claimed in claim 1 further comprising an alternate embodiment where said ball is mounted at a ninety degree angle to said ball joint mounting plate which is an ideal orientation for a full length door latch where said mounting plate is fastened to a floor.

* * * * *